US007681281B2

(12) United States Patent
Schubring et al.

(10) Patent No.: US 7,681,281 B2
(45) Date of Patent: Mar. 23, 2010

(54) WEDGE ASSEMBLY

(75) Inventors: Gary L Schubring, Chesterfield, MI (US); Girishsingh A Mokashi, Sterling Heights, MI (US)

(73) Assignee: Newfrey LLC, Newark, DE (US)

( * ) Notice: Subject to any disclaimer, the term of this patent is extended or adjusted under 35 U.S.C. 154(b) by 1051 days.

(21) Appl. No.: 11/075,158

(22) Filed: Mar. 8, 2005

(65) Prior Publication Data

US 2006/0200939 A1 Sep. 14, 2006

(51) Int. Cl.
*E05F 5/02* (2006.01)

(52) U.S. Cl. ..... 16/86 B; 16/86 R; 296/146.9

(58) Field of Classification Search ..... 16/82, 16/86 A, 86 B, 86 R; 296/56, 76, 146.8, 296/146.9, 207, 455; 52/716.1, 716.5–716.7
See application file for complete search history.

(56) References Cited

U.S. PATENT DOCUMENTS

| | | | | | |
|---|---|---|---|---|---|
| 1,089,193 | A | | 3/1914 | Ervien | |
| 1,884,998 | A | | 10/1932 | Perry | |
| 3,140,517 | A | | 7/1964 | Richter | |
| 4,192,039 | A | | 3/1980 | Haberle et al. | |
| 4,261,612 | A | | 4/1981 | Chrysler et al. | |
| 4,907,838 | A | * | 3/1990 | Reaney | 296/146.9 |
| 4,969,295 | A | * | 11/1990 | Nishikawa et al. | 296/146.2 |
| 5,024,480 | A | * | 6/1991 | Petrelli | 296/146.9 |
| 5,356,194 | A | * | 10/1994 | Takeuchi | 296/146.9 |
| 5,421,124 | A | | 6/1995 | Zuccaro | |
| 5,549,351 | A | | 8/1996 | Park | |
| 5,791,723 | A | | 8/1998 | Bell et al. | |
| 5,992,021 | A | * | 11/1999 | Takeda et al. | 296/146.9 |
| 5,992,927 | A | | 11/1999 | Scroggie | |
| 6,007,140 | A | * | 12/1999 | Heitmann et al. | 296/146.9 |
| 6,039,388 | A | | 3/2000 | Choi | |
| 6,039,389 | A | | 3/2000 | Monette et al. | |
| 6,099,068 | A | * | 8/2000 | Kim | 296/146.9 |
| 6,206,455 | B1 | | 3/2001 | Faubert et al. | |
| 6,247,744 | B1 | | 6/2001 | Townsend et al. | |
| 6,318,795 | B1 | | 11/2001 | Pyo | |
| 6,349,989 | B1 | | 2/2002 | Kim | |
| 6,386,619 | B1 | * | 5/2002 | Tsuchida | 296/146.9 |
| 6,530,618 | B2 | * | 3/2003 | Nozaki et al. | 296/146.9 |
| 6,536,833 | B2 | * | 3/2003 | Nozaki | 296/146.9 |
| 6,641,204 | B2 | * | 11/2003 | Ogawa et al. | 296/146.9 |
| 6,676,201 | B2 | | 1/2004 | Im et al. | |

(Continued)

FOREIGN PATENT DOCUMENTS

| | | |
|---|---|---|
| EP | 0540053 | 11/1992 |

(Continued)

OTHER PUBLICATIONS

International Search Report dated Aug. 17, 2006 (2 pgs).

*Primary Examiner*—William L. Miller
(74) *Attorney, Agent, or Firm*—Harness, Dickey & Pierce, P.L.C.

(57) ABSTRACT

A vehicle door wedge assembly has an elastomeric wedge connected to a first member, and a second member. A wedge perimeter wall has exterior facing and engagement portions, and an interior wall equidistantly spaced from the engagement portion. The interior and engagement walls define an interior cavity. The exterior facing wall deflects into the interior cavity during engagement of the first and second members.

17 Claims, 8 Drawing Sheets

U.S. PATENT DOCUMENTS 6,811,194 B1 * 11/2004 Gaertner et al. ..... 296/1.08
6,814,393 B2 * 11/2004 Nagata ..... 296/146.9
6,846,034 B1 * 1/2005 Angus et al. ..... 296/146.9
6,857,166 B2 2/2005 Nakagaki et al.
7,121,046 B2 * 10/2006 Baratin et al. ..... 49/479.1
7,182,394 B2 * 2/2007 Fukushima ..... 296/146.9
2005/0060867 A1 3/2005 Schubring et al.
2005/0093342 A1 * 5/2005 Kim ..... 296/207

FOREIGN PATENT DOCUMENTS

FR 2703395 A1 * 10/1994
GB 274502 A 11/1927

* cited by examiner

WEDGE ASSEMBLY

FIELD OF THE INVENTION

The present invention relates in general to displacement limiting systems and more specifically to a device and method for coupling use for vehicle door wedge systems.

BACKGROUND OF THE INVENTION

Vehicles including automobile sport utility vehicles, station wagons, mini-vans, cross-over vehicles, cargo vans and trucks often provide an access door, commonly known as a lift-gate door. Other similar door designs include hatchback doors, sliding doors and horizontally swinging doors. Although these door designs can be mounted differently, for simplicity, these door designs will hereinafter be summarized in reference to lift-gate doors. Lift-gate doors are frequently hinged along an upper horizontal surface, and latch adjacent to a flooring system of the automobile, commonly adjacent to the rear fender of the automobile. One or more latches can be used. The side edges of lift-gate doors are generally not hinged or physically connected to the vehicle structure or support posts at the rear of the vehicle. Motion of the vehicle therefore can result in "match-boxing", or non-parallel deflection of the support posts relative to the squared sides of the lift-gate door.

Match-boxing is undesirable for several reasons. First, side-to-side or non-parallel motion of support posts can impart additional vehicle noise, known as "chucking" at the lift-gate latch as the vehicle travels along rough or uneven surfaces. Second, vehicle drive train vibration known as idle or "drive train boom" can be transmitted as noise into the passenger compartment via known sliding wedge designs. Third, unless a mechanism is positioned between the lift-gate door edge and the support posts of the vehicle, full structural allowance for the stiffness of the lift-gate cannot be used in the design of the support structure area.

In order to include the stiffness of the lift-gate door in the analysis and design of structural support posts, wedge assemblies having movable slides have been used which displace to span the gap between the lift-gate door and the support post. These assemblies reduce match-box deflection of the support posts by transferring some deflection load to the lift-gate door using wedge assemblies generally positioned between each support post and the lift-gate door. The wedge assembly can be fastened to either or both edges of the lift-gate door or to an edge of one or both of the support posts. In a further known design, a slide assembly is positioned against each lift-gate door side edge and a striker plate is separately mounted to each support post such that the slide engages the striker plate to limit match-boxing of the support posts.

Common designs for sliding wedge assemblies have several problems. First, vehicle rattling noise is produced if the slide is not maintained in continuous contact with the striker plate (or vehicle support post) throughout the travel length of the slide. Tolerances used for common wedge assembly slides permit easy translation, but can result in rattling between the parts during vehicle travel. Second, vehicle build variation, vehicle manufacturing tolerances and/or frame vertical deflection during vehicle use can contribute to a disconnect or non-contact between the slide and the striker plate (or vehicle support post). If the slide is not maintained in contact with the vehicle support post or striker plate, rattling can occur. Third, contaminants such as dirt which contact portions of the wedge assembly could prevent the slide from moving freely, thus potentially resulting in increased chucking and/or increased lift-gate closing effort. Fourth, the hard plastic material commonly used for sliding wedge designs may not dampen the vibration caused by the drive train during idle operation, thus further contributing to drive train boom.

SUMMARY OF THE INVENTION

According to a preferred embodiment a wedge assembly of the present invention includes first and second members each having a wedge contact side. An elastically deflectable wedge is connectable to the wedge contact side of the first member. The wedge has a perimeter wall defining a partially enclosed interior cavity. A curved wedge engagement surface of the wedge contact side of the second member is positioned for frictional engagement with the wedge. The perimeter wall of the wedge is deflectable at least partially within the interior cavity to accommodate a relative displacement between the first and second members.

According to another aspect of the invention, a vehicle door wedge device includes first and second members each having a wedge contact side. A deflectable wedge is connected to the wedge contact side of the first member. The wedge has a perimeter wall defining an engagement wall portion and an outward facing wall portion, and an interior wall aligned substantially equidistantly to the engagement wall portion. The interior wall and the outward facing wall portion together define a partially enclosed interior cavity. The outward facing wall portion of the wedge is inwardly deflectable into the interior cavity and toward the interior wall to accommodate a relative displacement between the first and second members.

According to still another aspect of the invention, an automotive vehicle including a plurality of wedge assemblies of the present invention is provided. A method for using first and second wedge assembly members and a deflectable wedge to releasably couple a vehicle door to a vehicle body is also provided.

Wedge assemblies of the present invention provide several advantages. By eliminating the harder plastic sliding wedges of known wedge assemblies and replacing the sliding wedge with a deflectable elastomeric material wedge, acoustic performance of the vehicle is improved, including reduction of the interior vehicle sound level due to drive train "boom". The deflectable elastomeric material wedge of the present invention also allows the sliding feature of previous designs to be eliminated, together with the spring or biasing element normally used to allow the wedge to slide. This reduces the number of parts, including eliminating the over-slam bumper previously used, and therefore the cost of the present invention wedge assemblies. The detrimental effects of dirt and similar materials which could previously effect the sliding motion of the wedge are reduced using a deflectable wedge of the present invention. Wedge assemblies of the present invention also provide an anti-chucking feature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description is merely exemplary in nature and is in no way intended to limit the invention, its application, or uses.

Figure 1:
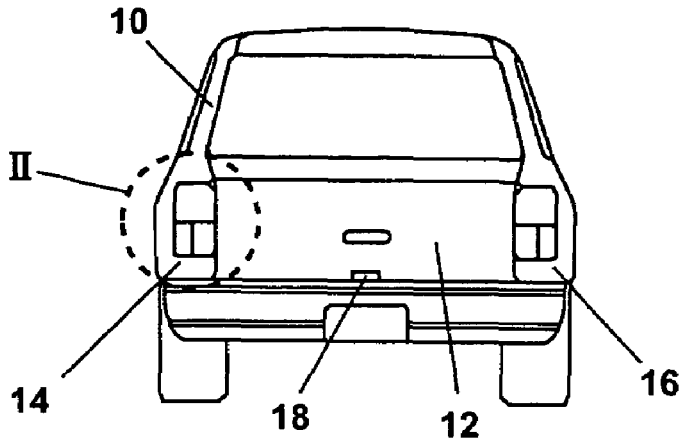
FIG. 1 is a rear elevational view of a vehicle having wedge assemblies of the present invention.

According to one preferred embodiment of the present invention and referring to FIG. 1, a vehicle 10 includes a rear lift-gate door 12 positioned between both a left support post 14 and a right support post 16 of vehicle 10. A latch 18 is generally provided about mid span along a bottom edge of rear lift-gate door 12. Side edges of rear lift-gate door 12 adjacent to left support post 14 and right support post 16, respectively, are generally not latched or otherwise connectable to left support post 14 or right support post 16.

Figure 2:
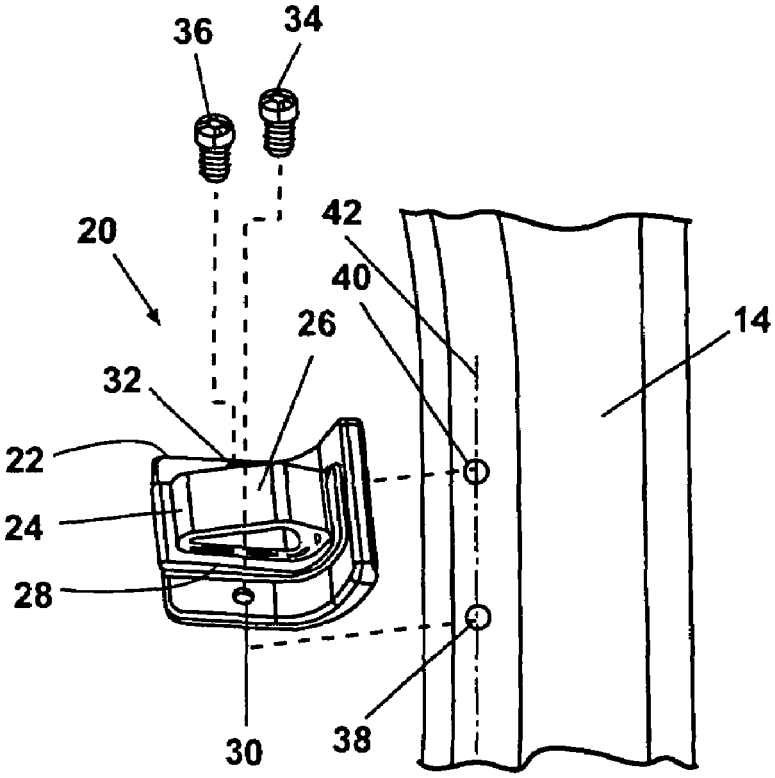
FIG. 2 is a fragmentary perspective view showing a wedge assembly taken from area II of FIG. 1.

As best seen in FIG. 2, a wedge sub-assembly 20 having a wedge support member 22 is supported from left support post 14. Wedge support member 22 is preferably provided of a "hard" polymeric material, for example a glass fiber reinforced polyamide material such as nylon 6-6, molded into the configuration shown. The term "molded" as used herein is intended to broadly encompass processes such as casting, injection molding, extrusion molding, pour molding, etc. The invention is not limited by the type of process used. In one embodiment, the glass fiber material is approximately 13% by weight of the total material volume of wedge support member 22 but can vary up to 33% or more by weight.

For simplicity, discussion of the present invention refers in general to wedge sub-assemblies 20 connected to left support post 14. Wedge sub-assemblies 20 of the present invention are not limited to specific locations, and can be connected to right support post 16 or other component parts including the rear lift-gate door of vehicle 10. Wedge sub-assemblies 20 of the present invention can be "non-handed" for general interchangeable use or can be configured in "left hand" and/or "right hand" configurations at the discretion of the designer.

A wedge 24 of an elastomeric material such as, but not limited to rubber, neoprene, silicon rubber, or elastically deformable polymeric material is connected to wedge support member 22. Wedge 24 includes an engagement surface 26 inclined with respect to a wedge contact face 28 of wedge support member 22. Wedge support member 22 further includes a first clearance aperture 30 and a second clearance aperture 32 (only partially visible in this view). A pair of metal or similarly known material fasteners 34 and 36 such as screws, self-tapping screws, self-tapping bolts are inserted through each of first clearance aperture 30 and second clearance aperture 32, respectively, to threadably engage with a first engagement aperture 38 and a second engagement aperture 40, respectively, provided in left support post 14. Pre-installed or pre-molded nuts (not shown) can also be used in place of the engagement apertures. First engagement aperture 38 and second engagement aperture 40 are commonly aligned on an aperture centerline 42 and pre-located to substantially equal a spacing between first clearance aperture 30 and second clearance aperture 32.

Figure 3:
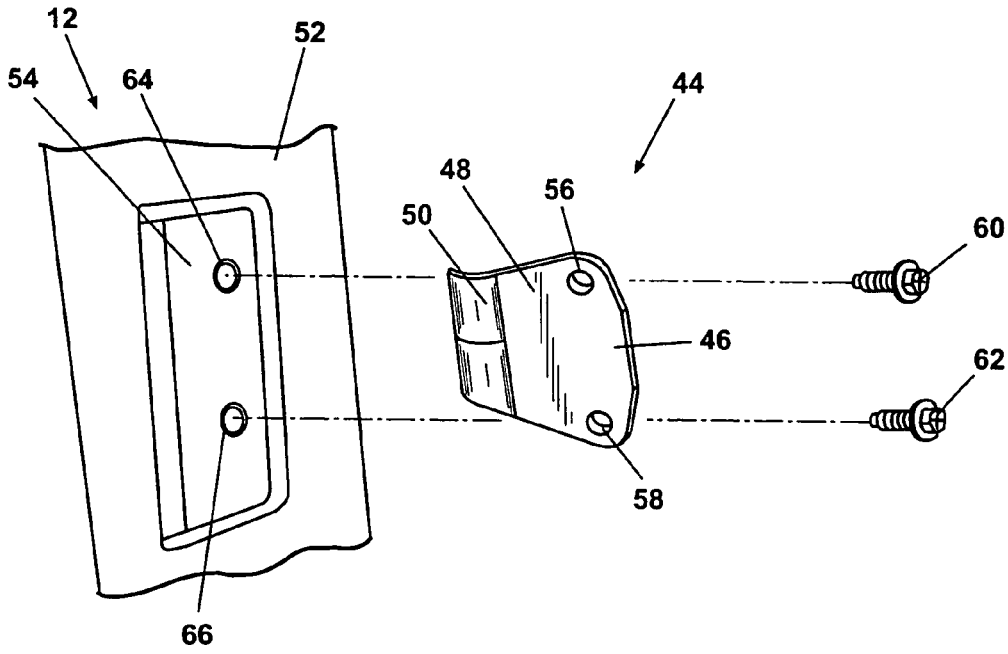
FIG. 3 is a fragmentary perspective view showing a striker member taken from area II of FIG. 1.

Referring generally to FIG. 3, a striker member 44 includes a striker body 46 having a substantially flat end 48 and a curved end 50. Striker body 46 is created of a similar material as wedge support member 22. Flat end 48 of striker member 44 is fastenably connected to a support surface 52 of rear lift-gate door 12. A recessed area 54 can be created within support surface 52 to provide a necessary flat seating surface for striker member 44. Flat end 48 of striker member 44 includes a first clearance aperture 56 and a second clearance aperture 58. A first fastener 60 and a second fastener 62 (similar to fasteners 34,36) are inserted through first clearance aperture 56 and second clearance aperture 58, respectively, to fastenably engage within a first engagement aperture 64 and a second engagement aperture 66, respectively. First and second engagement apertures 64 and 66 are also aligned and pre-located to substantially equal a spacing between first and second clearance apertures 56 and 58. Similar to wedge sub-assemblies 20, striker members 44 of the present invention are not limited to specific mounting locations, but are positioned to align with and engage wedge 24 of wedge sub-assemblies 20 when rear lift-gate door 12 is closed.

Figure 4:
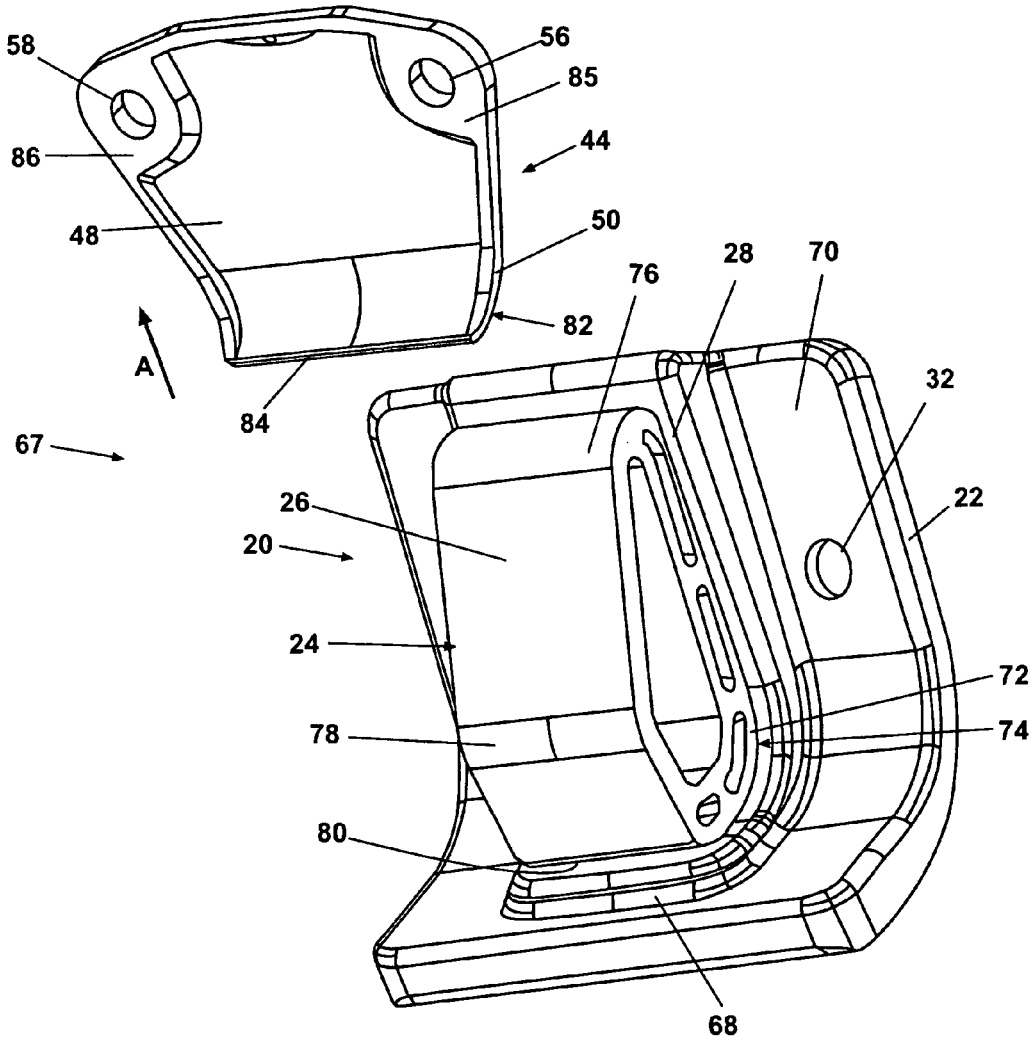
FIG. 4 is a perspective view of a wedge assembly of the present invention wherein the striker is not engaged with the wedge.

Referring now in general to FIG. 4, a total wedge assembly 67 includes a wedge sub-assembly 20 and a striker member 44. Wedge support member 22 can also provide a raised support area 68 to help locate and space wedge 24 with respect to striker member 44. Raised support area 68 is larger than a footprint of wedge 24 so that wedge contact face 28 is substantially smooth and flat where wedge 24 contacts wedge contact face 28. Raised support area 68 is raised with respect to a face 70 of wedge support member 22. First and second clearance apertures 32,34 (only second clearance aperture 34 is visible in this view) are provided through face 70. Wedge 24 includes an engagement wall 72 that abuts wedge contact face 28 to operably form a contact joint 74. In one embodiment of the present invention, contact joint 74 provides a completely bonded joint between wedge 24 and wedge contact face 28 formed in during a single or double shot molding process of wedge 24 and wedge support member 22. Contact joint 74 can also be provided with a layer of adhesive to create an adhesively bonded joint or can be created as a mechanically connected joint to be described later herein. Wedge 24 also includes first radial end 76 and a rounded contact face 78 having engagement surface 26 positioned between, and a second radial end 80.

Striker member 44 further includes a curved wedge contact surface 82 of curved end 50 and a distal edge 84. To stiffen mounting striker member 44 for mounting, a first reinforcement area 85 can be provided proximate to first clearance aperture 56 and a second reinforcement area 86 can be provided proximate to second clearance aperture 58. When wedge support member 22 is connected to rear lift-gate door 12 and the door is closed, wedge 24 contacts curved wedge contact surface 82 in the direction of arrow "A". It is desirable that distal edge 84 be positioned to not directly contact wedge 24. This helps prevent abrading the softer material of wedge 24.

Figure 5:
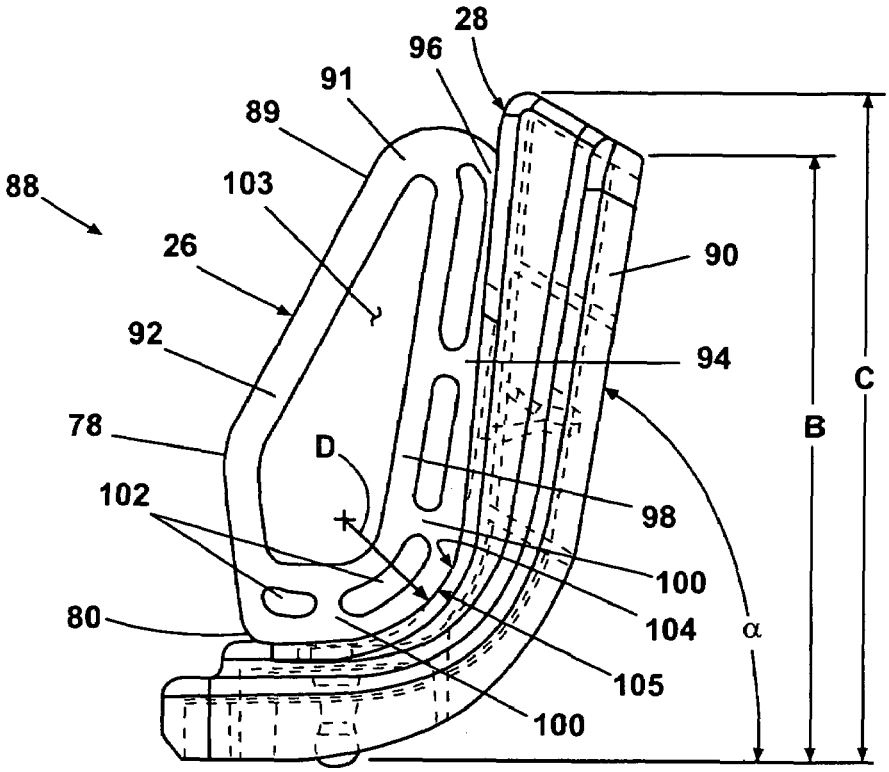
FIG. 5 is a side elevational view of a wedge sub-assembly of the present invention.
Figure 6:
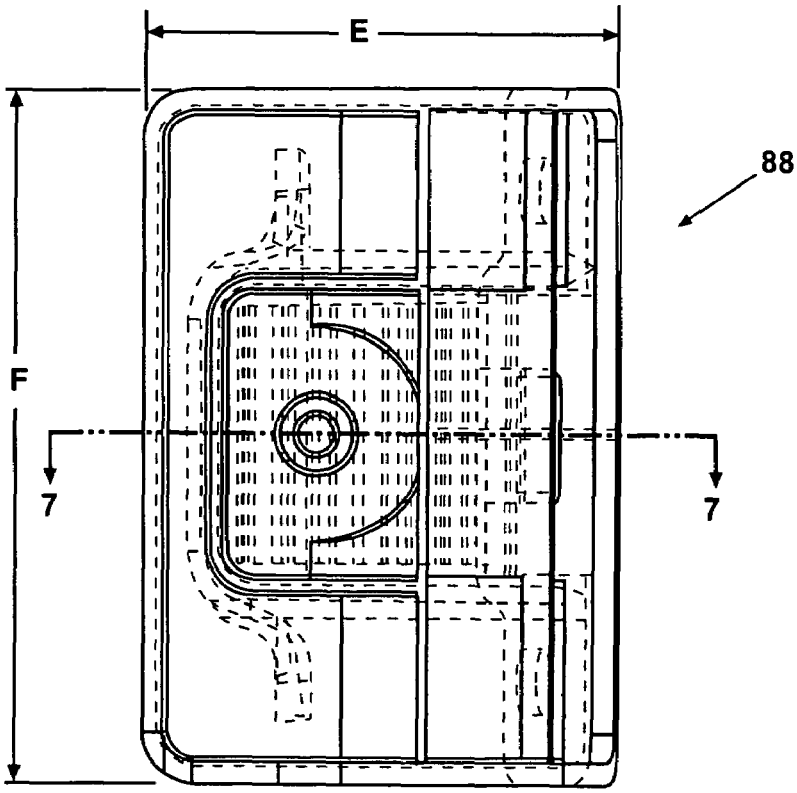
FIG. 6 is a bottom plan view of the wedge sub-assembly of FIG. 5.

Referring next to FIGS. 5 and 6, a wedge assembly 88 according to another preferred embodiment of the present invention includes a wedge 89 mechanically mounted to a wedge support member 90. Most features of wedge assembly 88 are similar to wedge assembly 22 and are therefore numbered the same. Wedge 89 provides a perimeter wall 91 having an exposed or outward facing wall 92 and an engagement wall 94 similar in shape to engagement wall 72. A portion 96 of engagement wall 94 is shown as it can be compressed against wedge contact face 28 when wedge 24 is subsequently contacted by striker member 44. To further stiffen engagement wall 94, an inner wall 98 is created which is integrally joined to engagement wall 94 with a plurality of spacers 100. A plurality of cavities 102 can be provided to reduce a molding or casting cost of wedge 89, the cavities 102 generally being defined between proximate ones of the spacers 100 or between a spacer 100 and a connection between outward facing wall 92 and engagement wall 94. A partially enclosed interior or main cavity 103 is defined within outward facing wall 92 and engagement wall 94.

A height "B" of wedge assembly 88 can vary for different lengths of the vehicle surface(s) engaged and in one embodiment is approximately 3 in (7.6 cm). A total height "C" of wedge assembly 88 varies depending on a depth of raised support area 68 and in one embodiment is approximately 3 3/16 in (8.1 cm). An orientation angle $\alpha$ can vary generally between approximately 60 degrees to approximately 90 degrees, but the invention is not limited by this range of orientation angle $\alpha$. A radius "D" defining a male arc-shaped portion 104 of wedge 89 is provided which abuts with a corresponding female arc-shaped portion 105 of wedge support member 90 at wedge contact face 28. Wedge assembly 88 also includes a total depth "E" and a total width "F" which also can vary with the application. In one embodiment, total depth "E" is approximately 1 3/4 in (4.4 cm) and total width "F" is approximately 3 3/16 in (8.1 cm).

Figure 7:
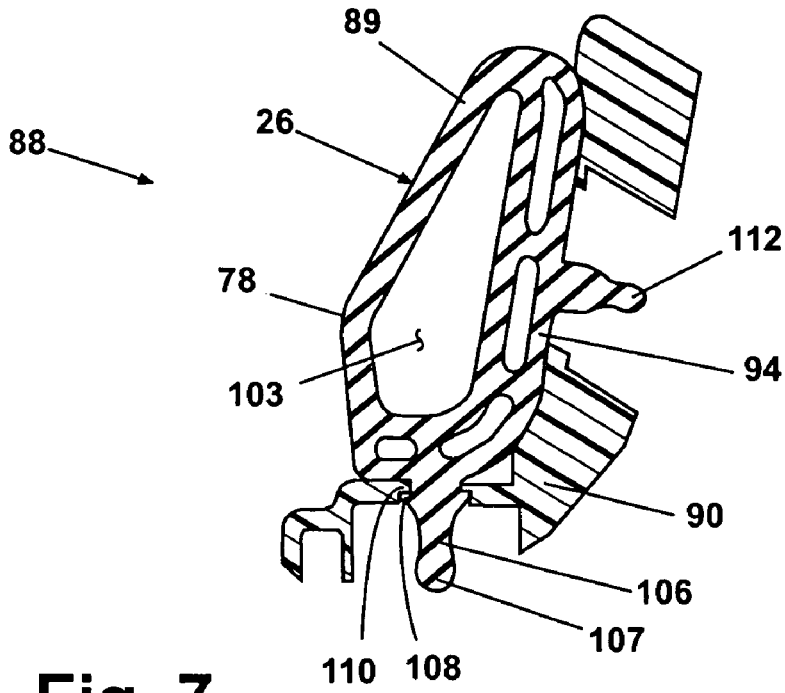
FIG. 7 is a cross sectional side elevational view of the wedge sub-assembly of FIG. 5 taken at section 7.

Referring next to FIG. 7, wedge 89 differs from wedge 24 primarily by the addition of mechanical connection elements integrally extending from at least one location on engagement wall 94. In the example shown in FIG. 7, a first male extending member 106 includes a bulbous head 107 at a distal end and a mating ring 108 positioned proximate to engagement wall 94. Mating ring 108 deflects when passed through a retention ring 110 of wedge support member 90 and elastically expands to "lock" wedge 89 in the position shown. A second male extending member 112 also integrally extends from engagement wall 94.

Figure 8:
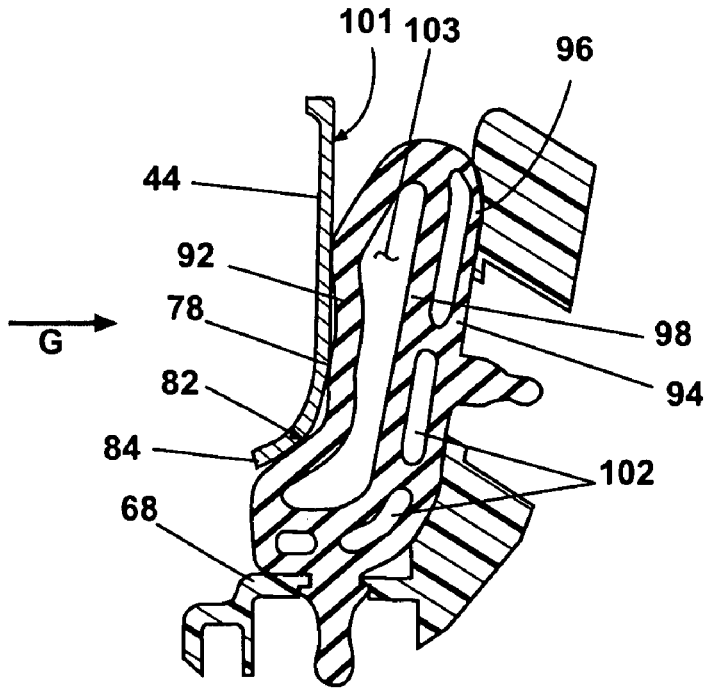
FIG. 8 is a cross sectional side elevational view of the wedge sub-assembly similar to FIG. 7 further showing an engaged or deflected condition between the striker and wedge.

Referring now to FIG. 8, a deflected condition of wedge 89 of wedge assembly 88 is shown. When curved wedge contact surface 82 of striker member 44 contacts outward facing wall 92, substantially only outward facing wall 92 of wedge 89 deflects. Engagement wall 94 and inner wall 98 can deflect, but do not substantially deflect, therefore cavities 102 do not substantially compress. Outward facing wall 92 elastically deflects partially into main cavity 103. In one embodiment, outward facing wall 92 deflects during normal conditions up to approximately 1/4 in (0.6 cm). It is desirable that outward facing wall only partially deflect into main cavity 103 during a normal or design deflection condition, to retain additional deflection space within main cavity 103 without outward facing wall 92 contacting inner wall 98. Portion 96 of engagement wall 94 can partially compress against wedge contact face 28 when wedge 24 is contacted by striker member 44.

Figure 9:
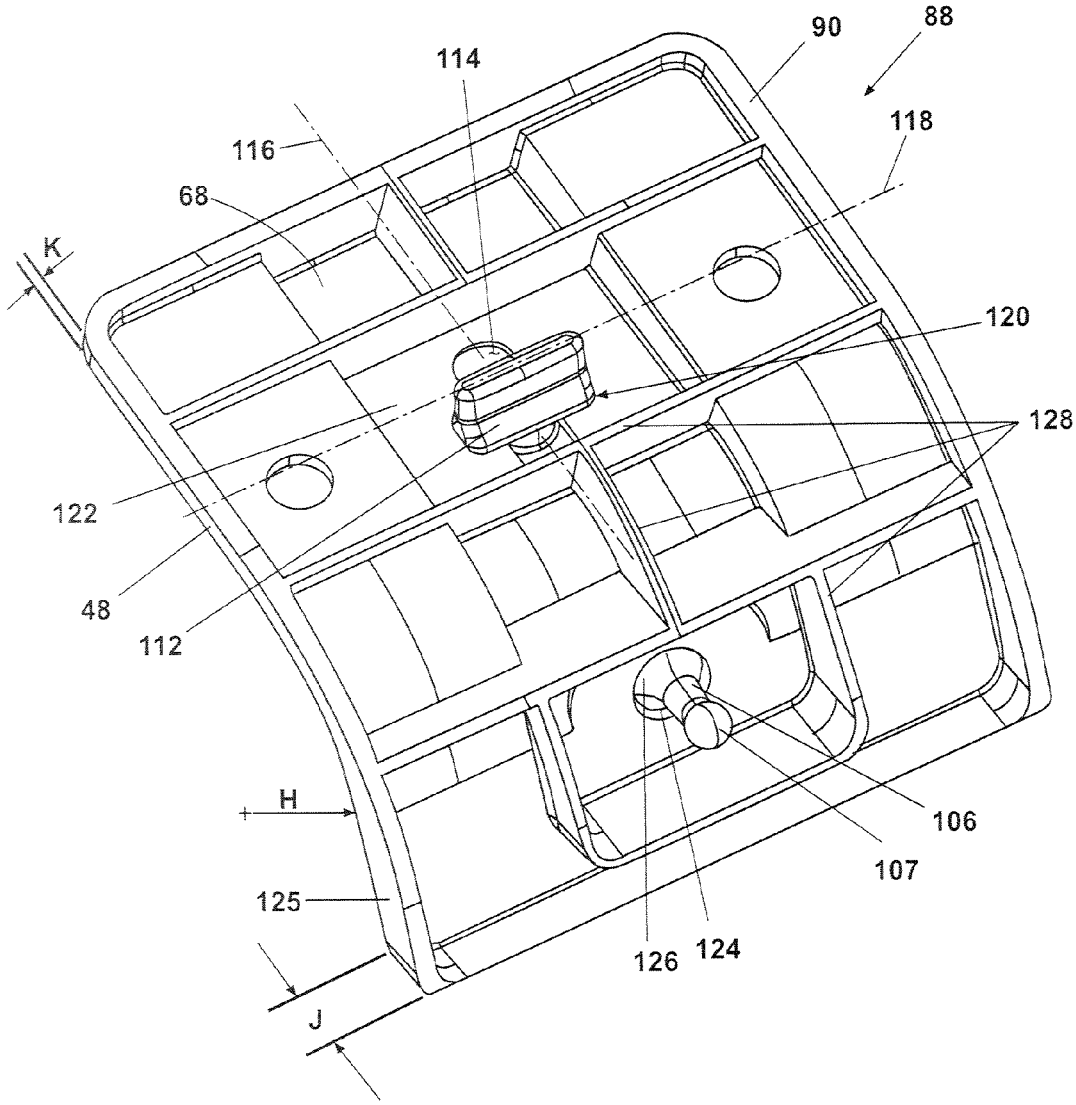
FIG. 9 is a rotated bottom perspective view of the wedge sub-assembly of FIG. 5.

As best seen in reference to FIG. 9, the mechanical connections of wedge assembly 88 are clearly seen. To connect wedge 89 to wedge support member 90, second male extending member 112 is initially aligned with and inserted through an elongated aperture 114. Elongated aperture 114 is longitudinally oriented with a first axis 116. After second male extending member 112 is inserted through elongated aperture 114, second male extending member 112 is rotated approximately 90 degrees to align with a second axis 118. In one embodiment, second axis 118 is substantially perpendicular to first axis 116. This 90 degree rotation engages a surface 120 of second male extending member 112 with a second surface 122 of raised support area 68 which prevents removal of wedge 89 unless the rotation is reversed.

To complete the installation of wedge 89, bulbous head 107 of male extending member 106 is inserted through a clearance aperture 124 created for this purpose in a radius end 125 while elastically deflecting mating ring 108 at retention ring 110. A conical section 126 of male extending member 106 helps align male extending member 106 in clearance aperture 124.

Wedge support member 90 also includes a plurality of stiffening ribs 128 and a radius "H" at radius end 125. Radius end 125 can also vary in thickness from flat end 48. A thickness "J" of radius end 125 is preferably thicker than a thickness "K" at flat end 48 to allow for the extension of male extending member 104.

Figure 10:
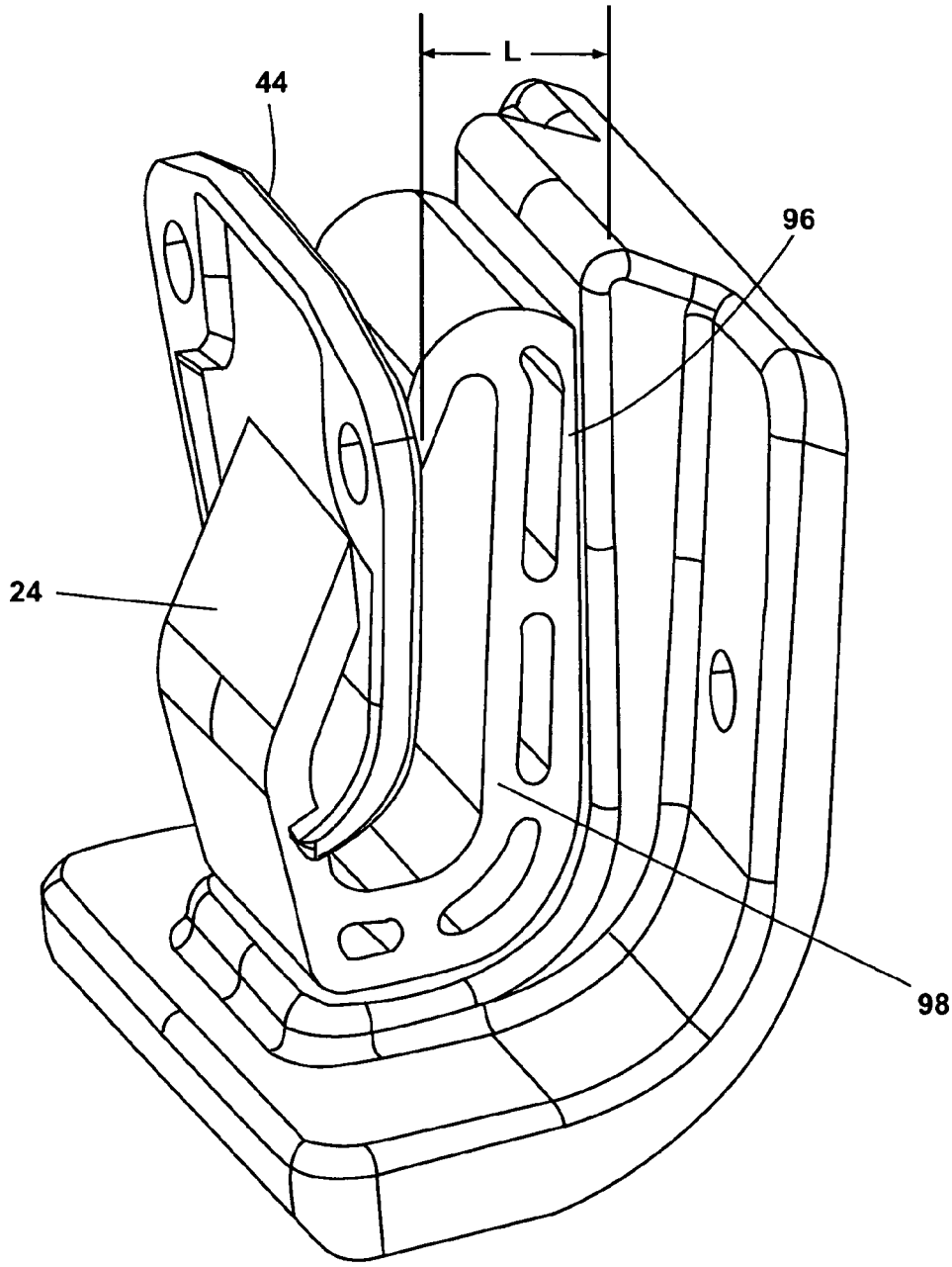
FIG. 10 is a perspective view of a wedge assembly of the present invention.

Referring to FIG. 10, an exemplary design interference "L" is predetermined by the designer to accommodate cross car tolerance stack-up for vehicle 12. The cross car tolerance stack-up varies between different vehicles 12 and includes a vehicle width tolerance, a lift-gate door installation tolerance, and an anticipated lift-gate door cross car deflection. When wedge assemblies of the present invention are positioned at both side edges of rear lift-gate door 12, design interference "L" is approximately 50% of the cross car tolerance. Design interference "L" is also predetermined to provide additional clearance between striker member 44 at its design deflection position shown and inner wall 98 to prevent striker member 44 "bottoming out" on inner wall 98 during normal vehicle operation. The interference position of striker member 44 also maintains minimum contact between striker member 44 and wedge 24 in a normally closed condition of rear lift-gate door 12 to permit a portion of the structural load of vehicle 10 to be transferred via the wedge assembly(ies) to rear lift-gate door 12.

At least the flat end 48 and curved wedge contact surface 82 of striker member 44 and preferably also the wedge contact face 28 and the face 70 of wedge support member 22 have a "grained" surface finish (not visible in the Figures), selected by the designer and provided during the molding, casting or curing process. There are several purposes for using a grained surface finish. A first purpose is to prevent the softer elastomeric material of the wedge 24 from adhering or sticking to the flat end 48 or the curved wedge contact surface of striker member 44. A second purpose is the grained surface finish improves the appearance of the outward or visible surfaces of the wedge assembly.

Figure 11:
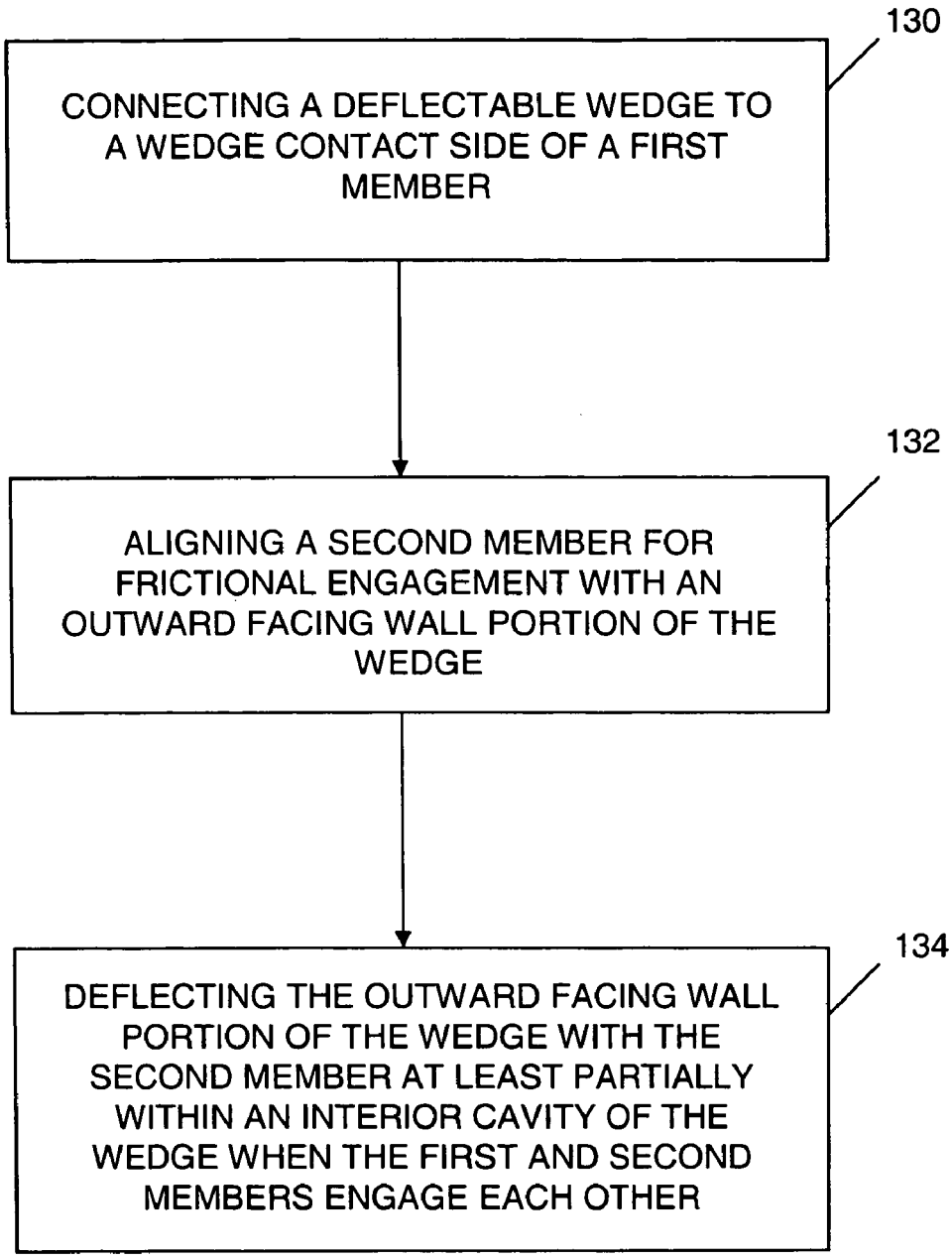
FIG. 11 is a flow diagram of a method for using first and second wedge assembly members and a deflectable wedge to releasably couple a vehicle door to a vehicle body.

Referring generally to FIG. 11, the method for using first and second wedge assembly members and a deflectable wedge to releasably couple a vehicle door to a vehicle body is described. In a first step 130, the method includes connecting the deflectable wedge to the wedge contact side of the first member. In a second step 132, the method includes aligning the second member for frictional engagement with the outward facing wall portion of the wedge. In a third step 134, the method includes deflecting the outward facing wall portion of the wedge with the second member at least partially within the interior cavity when the first and second members engage each other.

Wedge assemblies of the present invention provide a self-limiting stop for lift-gate door travel when the door is closed, because of the wedge taper shape and orientation. Previous designs for sliding wedge assemblies provide a rubber or similar material over-slam bumper to limit forward door closure travel. The use of an over-slam bumper is therefore obviated in the wedge assembly design of the present invention.

Wedge assemblies of the present invention provide several advantages. By eliminating the harder plastic sliding wedges of known wedge assemblies and replacing the sliding wedge with a deflectable elastomeric material wedge, acoustic performance of the vehicle is improved, including reduction of the interior vehicle sound level due to drive train "boom". The deflectable elastomeric material wedge of the present invention also allows the sliding feature of previous designs to be eliminated, together with the spring or biasing element normally used to allow the wedge to slide. This reduces the number of parts and therefore the cost of the present invention wedge assemblies. The detrimental effects of dirt and similar materials which could previously effect the sliding motion of the wedge are reduced using a deflectable wedge of the present invention. Wedge assemblies of the present invention also provide an anti-chucking feature.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vehicle door wedge and striker device, comprising:

first and second members each having a wedge contact side;

an elastically deflectable wedge connectable to the wedge contact side of the first member, the wedge having a perimeter wall defining a partially enclosed interior cavity, a male arc-shaped portion of an engagement wall portion of the perimeter wall, and an interior wall equidistantly spaced throughout a length of the interior wall to the engagement wall portion of the perimeter wall between first and second radial ends of the wedge and including the male arc-shaped portion;

a curve shaped wedge engagement surface of the wedge contact side of the second member being positionable for frictional engagement with the wedge;

a female arc-shaped portion of the wedge contact side of the first member adapted to abuttingly receive the male arc-shaped portion of the wedge;

wherein the perimeter wall of the wedge is elastically deflectable at least partially within the interior cavity when the first and second members contact each other, a design interference between the second member and the perimeter wall being predetermined to maintain clearance between the second member and the interior wall to prevent the second member from forcing the perimeter wall into contact with the interior wall when the perimeter wall is deflected into the interior cavity.

2. The device of claim 1, wherein the perimeter wall of the wedge further comprises an outward facing wall portion, the outward facing wall portion including an engagement surface inclined with respect to a wedge contact face of the first member and positioned where the perimeter wall of the wedge is elastically deflectable at least partially within the interior cavity by contact with the second member.

3. The device of claim 2, wherein the wedge further comprises a first male engagement member extending from the proximate portion of the perimeter wall opposite to the interior wall.

4. The device of claim 3, wherein the wedge further comprises a second male engagement member extending from the proximate portion of the perimeter wall opposite to the interior wall, the second male engagement member having a mating ring operable to releasably engage with a retention ring of the first member.

5. The device of claim 1, further comprising a plurality of spacer members integrally joining the interior wall to the engagement wall portion of the perimeter wall.

6. The device of claim 5, further comprising a plurality of sub-cavities each bounded by the interior wall and the engagement wall portion of the perimeter wall and at least one of the spacer members, the spacer members being spatially separated to increase stiffness of the interior and engagement walls to prevent substantial deflection of the sub-cavities during deflection of the perimeter wall toward the interior wall.

7. The device of claim 1, wherein each of the first and second members further comprise fastener receiving apertures operable to permit each member to be fastenably connected to a vehicle.

8. The device of claim 1, wherein the wedge contact side of the first member further comprises a raised wedge engagement surface.

9. A vehicle door wedge and striker device, comprising:

first and second members each having a wedge contact side;

an elastically deflectable wedge connectable to the wedge contact side of the first member, the wedge having a perimeter wall defining a partially enclosed interior cavity, the perimeter wall further including an engagement wall portion and an outward facing wall portion;

a curve shaped wedge engagement surface of the wedge contact side of the second member being positionable for frictional engagement with the wedge;

a first male engagement member extending from the proximate portion of the perimeter wall opposite to the interior wall;

a head of the first male engagement member having a substantially rectangular shape; and an elongated receiving aperture of the first member;

wherein the head is slidably received within the elongated aperture in a first orientation of the wedge, and the head is lockingly engageable to the first member when the wedge is rotated to a second orientation; and wherein the perimeter wall of the wedge is elastically deflectable at least partially within the interior cavity when the first and second members contact each other.

10. The device of claim 9, wherein the second orientation is rotated substantially 90 degrees from the first orientation.

11. A vehicle door wedge and striker device, comprising:

first and second members each having a wedge contact side;

a deflectable wedge connectable to the wedge contact side of the first member, the wedge having a perimeter wall defining an engagement wall portion and an outward facing wall portion, and an interior wall aligned substantially equidistantly to the engagement wall portion, the interior wall and the outward facing wall portion together defining a partially enclosed interior cavity, and at least one male engagement member extending from the engagement wall portion of the perimeter wall oppositely directed from the interior wall;

a plurality of spacers integrally joining the interior wall to the engagement wall portion of the perimeter wall;

a mating ring of the male engagement member; and a retention ring of the first member adaptable to receive and engage the mating ring, the mating ring being operable to lockingly engage with the retention ring of the first member; and wherein the outward facing wall portion of the wedge is inwardly deflectable toward the interior cavity to accommodate a relative displacement between the first and second members.

12. The device of claim 11, wherein proximate ones of the plurality of spacers define one of a plurality of sub-cavities each bounded by the interior wall and the engagement wall portion of the perimeter wall.

13. The device of claim 11, further comprising a curve shaped wedge engagement surface of the wedge contact side of the second member being positionable for frictional engagement with the wedge.

14. The device of claim 11, wherein the first and second members comprise a polyamide material.

15. The device of claim 11, wherein the wedge comprises a rubber material.

16. The device of claim 11, wherein the wedge comprises an elastic polymeric material.

17. The device of claim 11, wherein the first member further comprises a plurality of reinforcement ribs.

* * * * *